United States Patent [19]

Uchida

[11] 4,361,396

[45] Nov. 30, 1982

[54] COLLECTING APPARATUS FOR SCATTERING TONER

[75] Inventor: Tohru Uchida, Hachioji, Japan

[73] Assignee: Konishiroku Photo Industry Co., Ltd., Japan

[21] Appl. No.: 122,710

[22] Filed: Feb. 19, 1980

[30] Foreign Application Priority Data

Feb. 24, 1979 [JP] Japan ..... 54-20211

[51] Int. Cl.[3] ..... G03G 21/00; G03G 15/00

[52] U.S. Cl. ..... 355/15; 15/256.51; 355/3 DD

[58] Field of Search ..... 355/3 R, 15, 3 DD; 15/256.51, 256.52

[56] References Cited

U.S. PATENT DOCUMENTS

| | | | |
|---|---|---|---|
| 3,685,485 | 8/1972 | Kutsuwada et al. | 355/15 X |
| 3,743,540 | 7/1973 | Hudson | 355/15 X |
| 4,006,987 | 2/1977 | Tomono et al. | 355/15 |
| 4,014,065 | 3/1977 | Hudson | 355/15 X |
| 4,026,701 | 5/1977 | Till et al. | 355/15 X |
| 4,054,381 | 10/1977 | Bernhard | 355/15 |
| 4,154,521 | 5/1979 | Tanaka | 355/15 X |

*Primary Examiner*—Fred L. Braun

*Attorney, Agent, or Firm*—Bierman & Bierman

[57] ABSTRACT

An apparatus for collecting scattering magnetic toner includes an air flow path, a toner collecting chamber at one end of the flow path, a suction device for generating a directional flow of air for transporting scattering toner through the air flow path to the toner collecting chamber, and magnets in the collecting chamber for facilitating collection of toner therein. A filter formed of magnetizable material may be further provided in the magnetic field within the collecting chamber for enhancing the collection capacity and efficiency of the apparatus.

8 Claims, 2 Drawing Figures

COLLECTING APPARATUS FOR SCATTERING TONER

BACKGROUND OF THE INVENTION

This invention relates to a collecting apparatus for scattering toner.

Generally, in a recording apparatus such as an electrophotographic copying machine, an electrostatic recording apparatus or the like, a fine colored powder referred to as toner is widely used as a developing agent to develop an electrostatic latent image. Being a fine powder, this toner is susceptible to scattering in the interior of the recording apparatus, thereby resulting in various problems. In the developing portion of a recording apparatus, the toner must be placed in direct contact with the supporting surface (as of a photosensitive member) on which the latent image of an original document to be copied is formed. As the supporting surface is operatively moved in corresponding relation to scanning of the original document, the scattering of toner brought into contact with the latent image bearing surface inevitably occurs within the machine interior. Yet it is virtually impossible to effectively close the development chamber and, in many cases, an air flow normally circulated within the interior of the recording apparatus for cooling and the like further contributes to toner scattering. As a consequence, the scattering toner contaminates the interior of the apparatus, stains or degrades the visible image formed in the copying process, and additionally hinders effective functioning of the apparatus.

It is therefore desirable to collect such scattering toner and the prior art teaches, for such purpose, forced transport of scattering toner by a stream of air and collection by a filter inserted in the air stream path. In known collecting means of this type, however, clogging of the filter readily occurs due to the fine, powdery nature of the toner and, in operation, such a system has been found to be extremely inefficient as its collection capacity is very small.

OBJECTS OF THE INVENTION

In view of the above, it is an object of the present invention to provide a collecting apparatus for scattering toner that can reliably and efficiently collect the scattering magnetic toner now in use.

Another object of the invention is to provide a collecting apparatus having a relatively large collection capacity.

An exemplary embodiment of the present invention is now explained with reference to the accompanying drawings, in which the invention is implemented, by way of example, in an electrophotographic copying machine.

DESCRIPTION OF THE PREFERRED EMBODIMENT

Figure 1:
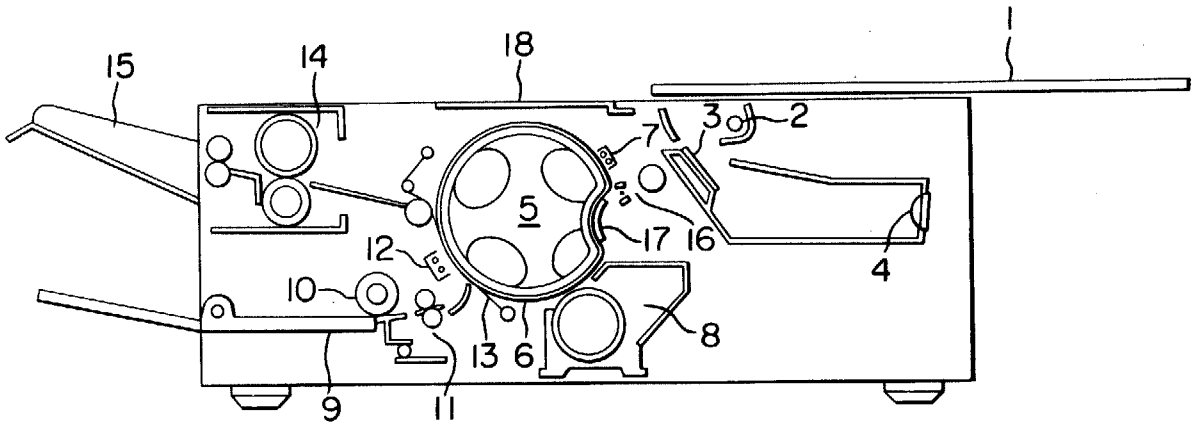
FIG. 1 is an explanatory view illustrating a constructional example of an electrophotographic copying machine to which the collecting apparatus for scattering toner of the present invention can be applied.

In FIG. 1, a copy board supported in a movable manner is represented by reference numeral 1. An original placed on copy board 1 is irradiated by a light source 2 and a light image reflected from the original is projected onto a photosensitive body 6 installed on the outer surface of a revolving drum 5 through a reflection mirror 3 and a lens unit 4 consisting of a lens and a mirror positioned behind the lens. Photosensitive body 6 is initially charged by an electric charger 7 prior to projection thereon of the light image of the original and, consequently, on projection of said original light image, an electrostatic latent image corresponding to the original to be copied is formed on body 6. This latent image is then developed with magnetic toner in a developing device 8 and the toner image so formed is subsequently transferred by means of a transferring electrode 12 onto a transfer paper (not shown). The transfer paper is fed from a paper tray 9 by a paper supplying roller 10 through paired feeding rollers 11. After the toner image has been transferred to a sheet of transfer paper, the paper sheet is separated from photosensitive body 6 by a separating belt 13 and is then fed to a heating roller type fixing device 14 where the toner image is fixed, the transfer paper thereafter being delivered to a paper receiving tray 15.

Photosensitive body 6 moves in accordance with the rotation of drum 5 and, after charge neutralization by a neutralizing device 16 composed of an electrical neutralizing electrode and a neutralizing lamp, the residual toner remaining on body 6 is cleaned therefrom by developing device 8 and the photosensitive body 6 is moved further along to be next prepared for the following copying operation. Reference numeral 17 denotes a member for enabling installation or attachment of the sheet type photosensitive body 6 to the peripheral surface of drum 5, while numeral 18 designates a movable opening and closing door formed on the top surface of the outer casing of the machine, the opening of which permits ready charging or replacement of photosensitive body 6.

Figure 2:
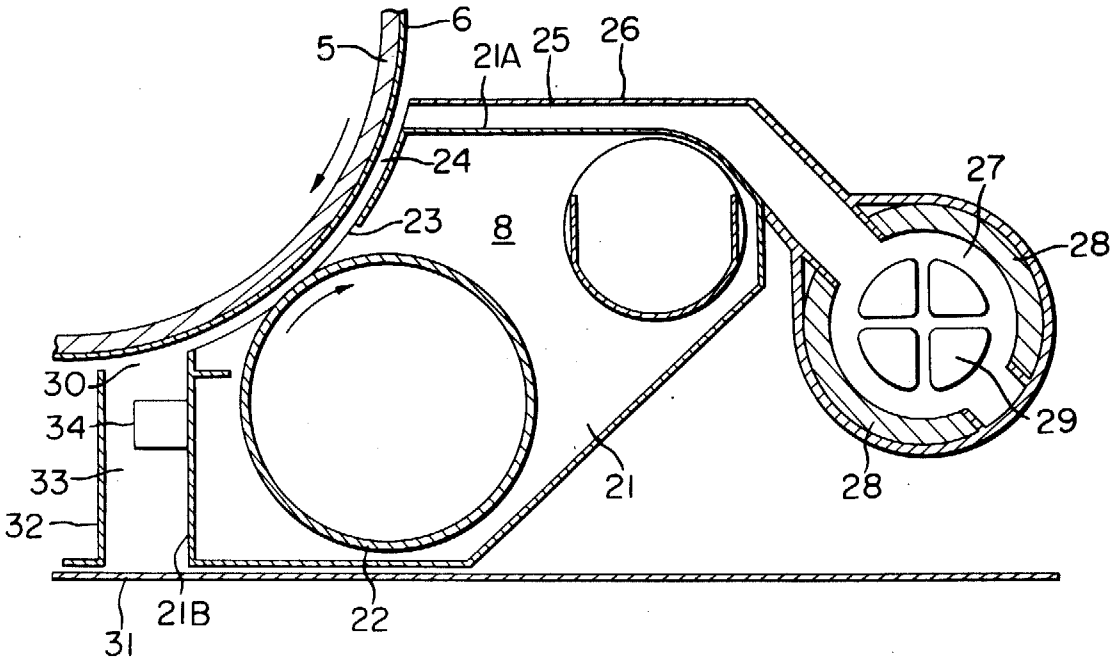
FIG. 2 is a cross-sectional, diagrammatic view illustrating, with partial omission, an embodiment of the invention in which two different units constructed in accordance with the invention are applied to the developing portion of an electronic copying machine.

In developing device 8, a rotatable sleeve 22 is installed in a housing (or toner tank) 21, as is shown in FIG. 2, and the outer surface of sleeve 22 and the surface of photosensitive body 6 on drum 5 are oppositely disposed and spaced apart at an opening 23 formed in housing 21 at the developing area or zone. The magnetic force of magnets (not shown) fixed within rotatable sleeve 22 causes magnetic toner ears or magnetic brush tufts of toner to form and be carried on the outer surface of sleeve 22. Moreover, the spacing between the outer surfaces of body 6 and of sleeve 22 at the development zone is such that the surface of photosensitive body 6 is contacted and rubbed with said toner brush tufts, whereby the toner is adsorbed from the tufts onto rotating photosensitive body 6 by the electrostatic charge of the latent image formed on body 6, resulting in development of the latent image into a visible image.

In accordance with the present invention, a partition wall or member 26—together with an upper wall 21A of housing 21—forms an air flow path 25 that interconnects the air flow path with a space 24 defined between housing 21 and the outer surface of drum 5 upstream of and adjacent to development zone opening 23 of housing 21. In addition, a toner collecting chamber 27 is established in communication with the connected to air flow path 25. In other words, one end of air flow path 25 communicates with a development portion or zone, and another or opposite end thereof connects to the toner collecting chamber 27. Air flow path 25 may, of course, alternatively be formed without making use of a portion of housing 21.

At least two permanent magnets—or, more broadly, magnetic force generating means—28 of respectively opposite polarity to each other are fixed in spaced apart relation on an interior wall of toner collecting chamber 27 so as to define a space or cavity therebetween. An air outlet 29 connected to the suction side of a suction means, such as a fan (not shown), is formed in chamber 27, and the space or cavity defined between the permanent magnets 28 is filled with a toner catching or trapping means (not shown) formed, for example, of randomly coiled steel wire. As should be understood from the foregoing description, the toner catching means is disposed within the magnetic field generated by the magnets 28 in toner collecting chamber 27. The air flow path—or the members which form the path—and the toner collecting chamber can be constructed unitarily or of separate components, being a matter of design choice.

Another partition wall 32 partitions the area or space 30 defined along the outer surface of drum 5 downstream of and adjacent to development zone opening 23 of housing 21. This partitioning results in the formation of a second toner collecting chamber 33 in which is arranged a permanent magnet 34, magnet 34 being oriented transversely along the width of the peripheral surface of drum 5.

As a consequence of the disclosed structure and arrangement of the collecting apparatus for scattering toner of the present invention, a portion of the scattering toner generated near opening 23 of housing 21 returns to housing 21. Most of the scattering toner particles, however, are sucked or drawn into toner collecting chamber 27 from the space 24 through air flow path 25 due to the air flow generated by the suction means or fan (not shown), such toner particles being adsorbed and collected by the magnetic force of permanent magnets 28. It is desirable and preferred that these opposing magnets be of respectively opposite polarity to each other.

In the absence of a toner catching means filling the interior of toner collecting chamber 27, it is not possible to secure a large collecting capacity although it is possible to achieve the collection of the toner. In the disclosed embodiment, the toner catching means is formed of a steel wire, the toner catching means being magnetized by the permanent magnets 28 surrounding the same and having a large surface area due to its randomly coiled configuration. Thus, the toner adsorbing area is large and it is possible to secure an extremely large collection capacity. Even where the toner catching means is formed, for example, of glass fiber or the like instead of a magnetizable material, however, each toner particle is magnetized by the magnetic force of the permanent magnets 28 and accordingly adheres to and accumulates on the surface of the toner catching means; it is therefore still possible to secure a large collecting capacity with only a slight decrease in collecting power. Moreover, since the toner is composed of fine particles, the permissable holding force with which the collected toner particles are not blown off by the air flow generated by the fan is readily obtained without the necessity of using permanent magnets 28 that have a particularly great magnetic force.

Inasmuch as the capture of toner particles by the toner catching means is accomplished by the magnetic force of the permanent magnets 28, it is unnecessary to form the toner catching means as having a small gap rate, and it is therefore possible to avoid or prevent clogging even with substantial increases in the amount of collected toner. As a consequence, there is no significant decrease in suction force by the fan and it is possible to collect a large quantity of scattering toner with the aforementioned large collection capacity.

A portion of the scattering toner also enters the space or area 30 at the downstream side of drum 5 during rotation thereof. However, since another toner collecting chamber 33 is so formed as to directly connect to the space 30, the scattering toner is adsorbed and collected on permanent magnet 34 by direct action of its magnetic force. In this case, therefore, the space 30 where scattering toner is generated is directly connected to toner collecting chamber 33 and, moreover, the scattering toner in space 30 is relatively small in amount. As a result, there is no practical necessity for providing a fan or a toner catching means to adsorb the scattering toner. In actual use, a good result can be obtained even when no toner collecting chamber 33 is provided, collection of scattering toner being effected solely by chamber 27.

In the foregoing description, a collecting apparatus for scattering toner in accordance with the present invention is applied to the development space of an electrophotographic copying machine. By providing the apparatus of the invention in the recording machine as disclosed, contamination of the machine interior by scattering toner is prevented, and it is possible to thereby avoid staining of the visible image operatively formed and to further prevent interference with proper and effective functioning of the machine. Moreover, with the apparatus of the invention in which the toner catching means is provided as disclosed, the desired action is reliably assured for a lengthy period of time because of its large collection capacity and it is therefore possible to extend the periods between required maintenance for the recording machine.

In this invention, various modifications of the disclosed embodiment can be effected as, for example, the use of an electromagnet mechanism instead of the permanent magnets 28, 34. Furthermore, the magnets may alternatively be arranged on partition wall 26 and the like that form air path 25. Air outlet 29 can be provided with an attached mesh filter or the like in order to positively prevent toner leakage therethrough. In addition, the air flow from the fan or suction means for adsorbing the scattering toner can be further utilized for cooling and the like.

In the inventive collecting apparatus for scattering toner, it is possible to insure collection of the scattering toner at a high efficiency and with an extremely simple construction because the scattering magnetic toner is guided to the toner collecting chamber where it is adsorbed and collected by utilization of magnetic force. This higher collection efficiency is obtained by positively feeding and directing the scattering toner into the toner collecting chamber under the force of an air flow. In addition, it is possible to obtain an extremely large collection capacity by arranging, in the toner collecting chamber, a toner catching means which preferably is formed of a strongly magnetizable material. The collecting apparatus for scattering toner of the present invention is thus extremely suitable for the collection of scattering toner generated in a non-sealed area where magnetic toner is handled, and especially for the collection of the scattering toner produced in the development space of a recording machine in which such magnetic toner is used as a developer.

What is claimed is:

1. In a recording machine which includes a developing device and which utilizes magnetic toner as a developing agent, collecting apparatus for scattering toner generated at a development zone and comprising:

means defining an air flow path communicating at one end thereof with the development zone;

means defining a toner collecting chamber at another end of said air flow path for communication with the development zone through said flow path and for receiving and collecting therein scattering toner;

suction means for generating a directional flow of air for transporting scattering toner through said air flow path from the development zone to said toner collecting chamber; and means in said collecting chamber for generating a magnetic field so as to facilitate collection in said chamber of scattering toner transported thereto from the development zone through said air flow path.

2. In a recording machine according to claim 1, said magnetic field generating means comprising at least two magnets so disposed in said collecting chamber as to define a cavity therebetween within which said magnetic field is generated.

3. In a recording machine according to claim 2, said magnets having respectively opposite polarities to each other.

4. In a recording machine according to claims 2 or 3, said collecting apparatus further comprising toner catching means disposed within said cavity of the collecting chamber for catching scattering toner transported through said air flow path from the development zone to said collecting chamber.

5. In a recording machine according to claim 4, said toner catching means comprising a magnetizable material, whereby the magnetizable material is magnetized by the magnetic field generated in said cavity by said magnets so as to enhance the collection of toner in said apparatus.

6. In a recording machine according to claim 5, said magnetizable material comprising randomly coiled wire.

7. In a recording machine according to claim 4, said toner catching means comprising a glass fiber material.

8. In a recording machine according to claim 1, said collecting apparatus further comprising:

means defining a second toner collecting chamber located adjacent the development zone; and second magnetic field generating means for drawing magnetic toner scattering about the development zone and said second collecting chamber into said second chamber for collection therein so as to supplement the collection of scattering toner in said first-mentioned collecting chamber.

* * * * *